US008956565B2

(12) United States Patent
Horie et al.

(10) Patent No.: US 8,956,565 B2
(45) Date of Patent: Feb. 17, 2015

(54) FLAKE GRAPHITE CAST IRON AND PRODUCTION METHOD THEREOF

(75) Inventors: Hiroshi Horie, Morioka (JP); Toshinori Kowata, Morioka (JP); Yoshiki Ishikawa, Saitama (JP)

(73) Assignees: Incorporated National University Iwate University, Morioka-Shi (JP); Nippon Piston Ring Co., Ltd., Saitama-Shi (JP)

( * ) Notice: Subject to any disclaimer, the term of this patent is extended or adjusted under 35 U.S.C. 154(b) by 685 days.

(21) Appl. No.: 12/666,670

(22) PCT Filed: Jun. 25, 2008

(86) PCT No.: PCT/JP2008/061517

§ 371 (c)(1),
(2), (4) Date: May 21, 2010

(87) PCT Pub. No.: WO2009/001841

PCT Pub. Date: Dec. 31, 2008

(65) Prior Publication Data

US 2010/0239451 A1 Sep. 23, 2010

(30) Foreign Application Priority Data

Jun. 26, 2007 (JP) ..... 2007-168123

(51) Int. Cl.
*C22C 37/10* (2006.01)
*C22C 37/08* (2006.01)
*C22C 33/08* (2006.01)

(52) U.S. Cl.
CPC ..... *C22C 37/10* (2013.01); *C22C 33/08* (2013.01)
USPC ..... 420/14; 420/27; 148/324

(58) Field of Classification Search
USPC ..... 148/500, 505, 320–324, 328, 330, 332, 148/333–337, 612–618; 420/9–33, 87, 420/89–93, 104–123
See application file for complete search history.

(56) References Cited

U.S. PATENT DOCUMENTS 2,494,238 A * 1/1950 Griggs et al. ..... 420/26
3,591,366 A * 7/1971 Triches et al. ..... 420/15

(Continued)

FOREIGN PATENT DOCUMENTS

DE 15 33 361 A1 1/1970
DE 31 46 120 A1 7/1982

(Continued)

OTHER PUBLICATIONS

D.M. Stefanescu, "Classification and Basic Metallurgy of Cast Iron," Properties and Selection: Irons, Steels, and High-Performance Alloys, vol. 1, ASM Handbook, ASM International, 1990, 23 pages total.*

(Continued)

*Primary Examiner* — Scott Kastler
*Assistant Examiner* — Vanessa Luk
(74) *Attorney, Agent, or Firm* — Burr & Brown, PLLC

(57) ABSTRACT

The invention provides a flake graphite cast iron being highly strong and excellent in workability such as cutting performance, which is suitable for use, for example, in internal combustion engine parts and the like, and a production method thereof without using a misch metal. Specifically, the flake graphite cast iron according to the invention includes an A-type graphite with a uniformly and disorderly distributed existence form without directionality; and has a chemical composition containing 2.8 to 4.0 mass % of C, 1.2 to 3.0 mass % of Si, 1.1 to 3.0 mass % of Mn, 0.01 to 0.6 mass % of P, 0.01 to 0.30 mass % of S and the remainder being Fe and inevitable impurities, wherein the ratio (Mn/S) of the Mn content to the S content is within a range of 3 to 300.

3 Claims, 2 Drawing Sheets

(56) References Cited

U.S. PATENT DOCUMENTS

| | | | | |
|---|---|---|---|---|
| 2005/0103161 | A1 | 5/2005 | Horie et al. | |
| 2005/0194071 | A1 * | 9/2005 | Takayama et al. | 148/539 |

FOREIGN PATENT DOCUMENTS

| | | | | | |
|---|---|---|---|---|---|
| GB | 2 116 585 | A1 | | 9/1983 | |
| JP | 55-051988 | | * | 4/1980 | F04C 18/344 |
| JP | 58-157947 | A1 | | 9/1983 | |
| JP | 60-211050 | | * | 10/1985 | C22C 37/08 |
| JP | 63-206448 | A1 | | 8/1988 | |
| JP | 02-258952 | A1 | | 10/1990 | |
| JP | 07-145445 | A1 | | 6/1995 | |
| JP | 07-145446 | A1 | | 6/1995 | |
| JP | 07-216495 | A1 | | 8/1995 | |
| JP | 07-305138 | A1 | | 11/1995 | |
| JP | 10-158777 | A1 | | 6/1998 | |
| JP | 2000-104138 | | * | 4/2000 | C22C 37/00 |
| JP | 2000-104138 | A1 | | 4/2000 | |
| JP | 2001-123241 | | | 5/2001 | |
| JP | 2003-171729 | A1 | | 6/2003 | |
| JP | 2004-169149 | | * | 6/2004 | C22C 37/00 |

OTHER PUBLICATIONS

Computer-Generated Translation of JP 2000-104138, published originally in Japanese on Apr. 11, 2000.*

Professional translation of JP 63-206448, originally published in Japanese on Aug. 25, 1988.*

Chinese Office Action dated Apr. 16, 2012 (with English translation).

Chinese Office Action dated Feb. 12, 2011 (with English translation).

Chinese Office Action dated Oct. 17, 2012 (with English translation).

Japanese Office Action dated Nov. 13, 2012 (with English translation).

Chinese Office Action (With English Translation), Chinese Application No. 200880102496.6, dated May 29, 2014 (16 pages).

Chinese Office Action (With English Translation), Chinese Application No. 201310030239.9, dated May 30, 2014 (16 pages).

* cited by examiner

FLAKE GRAPHITE CAST IRON AND PRODUCTION METHOD THEREOF

BACKGROUND OF THE INVENTION

1. Field of the Invention

This invention relates to a flake graphite cast iron suitable for use in engine parts of an internal combustion and the like and the production method thereof, which makes it possible to produce at a low price a cast iron being highly strong and excellent in workability such as cutting performance without using a misch metal and the like in particular.

2. Description of the Related Art

Conventionally, various studies have been done on engine parts of an internal combustion, wherein strength, stability of workability and cost reduction are required. For example, engine parts such as a cylinder liner or a piston ring are strongly required to have excellent wear resistance and scuffing resistance, since the piston ring needs to slide in the inner peripheral surface to maintain airtightness, so a special alloy cast iron having the structure that a graphite and a carbide are dispersed has been conventionally used. Although a cast iron with the addition of an alloy element such as molybdenum to enhance strength is cited as a special alloy cast iron, there is a problem that such a cast iron is poor in workability, shortens a cutting tool life and increases the working cost. Another problem is that the large addition of an expensive alloy element incurs an increase in the product cost.

In the production of the cast iron, from a viewpoint of effective use of resources, steel sheet scrap (steel scrap) is commonly used as a part of raw materials. In recent years, a high-tensile steel tends to be largely used as automobile materials for the purpose of collision safety improvement and vehicle weight reduction.

As an alloy element to add to the high-tensile steel, matrix structure strengthening elements such as Mn, Cr and Mo are cited. Among others, manganese is a low price and used most so that a huge amount of high-tensile scrap (steel scrap) containing a large amount of Mn is expected to be generated along with increase in the usage ratio of the high-tensile steel in the future.

Now, steel sheet scrap (steel scrap) is largely used as raw materials for a cast metal and a large amount of burrs and the like are generated as the steel scrap during pressing. Therefore, the high-tensile scrap mentioned above is expected to be used as an iron source.

Mn as one of the alloy elements hugely contained in the high-tensile scrap serves as a matrix structure strengthening element of stimulating pearlitic structure of a matrix and densifying spacing on cementite in the pearlite to strengthen it in a cast iron. However, Mn has a function of stabilizing a carbide to prevent crystallization of a graphite.

Therefore, at present, in order to produce a cast iron by using high-tensile scrap, steps such as dilution of Mn and removal of Mn are required. Since these steps involves increase in cost, it would be industrially very effective if a cast iron can be obtained directly without removing Mn.

Approximately 5 million tons of cast iron is produced a year in Japan. A cast iron of a graphite crystallized in flake state is called a flake graphite cast iron, approximately 3 million tons of which is produced a year, while a cast iron of a graphite crystallized in spheroidal state is called a spheroidal graphite cast iron, approximately 2 million tons of which is produced a year.

Moreover, the flake graphite cast iron generally has lower tensile strength than the spheroidal graphite cast iron. The main reason why the spheroidal graphite cast iron has higher tensile strength is that a graphite spheroidizing agent containing Mg, Ca, Ce and the like is added to a molten metal to spheroidize the graphite.

However, it has also become clear that sulfur (S) existing in the molten metal reacts with these elements to form a sulfide to thereby deteriorate graphite spheroidization.

Therefore, it is required to subject a molten metal containing a large amount of S to a treatment such as desulfurization treatment for lowering the amount of S or addition of a large amount of the graphite spheroidizing agent in advance. Since even a small amount of elements Sb, Sn, Pb, Ti and the like inhibits spheroidizing of the graphite, it is also required to remove these elements from raw materials such as scrap to make sure that these elements are not mixed therein.

Thus, while the spheroidal graphite cast iron can be produced to obtain a cast iron having high tensile strength, when the spheroidal graphite cast iron is produced from scrap, meticulous care and treatment are required for commingling of various elements and quantitative management of S, which generates a slag, is particularly important.

On the other hand, when the flake graphite cast iron is produced by using scrap, although much care is not required for the commingling of various elements as compared to the spheroidal graphite cast iron, it is generally difficult to obtain a flake graphite cast iron having tensile strength in the same level with the spheroidal graphite cast iron.

Moreover, S, which bonds to an iron (Fe) to become FeS to stimulate chilling when an amount of Mn is small in a cast iron, is generally recognized as a strong anti-graphitization element.

However, when Ms and S coexist in the molten metal of the cast iron, a stable sulfide (MnS) is formed and the ill effects of each are neutralized by each other. Furthermore, a possibility that MnS stimulates the nucleation of a graphite eutectic crystal is suggested.

While a study has been done on independent Mn or S, or a mutual relationship between the both elements, few studies assuming a high Mn composition are found other than the methods disclosed in Japanese Patent Application Laid-open Publication Nos. 2003-171729 and H10-158777 for example, which the subject inventors propose.

In both the methods disclosed in Japanese Patent Application Laid-open Publication Nos. 2003-171729 and H10-158777, wherein it is essential to add a rare-earth element or a misch metal twice as much as the amount of S in the molten metal, since the addition of the rare-earth metal or the misch metal deteriorates fluidity (melt fluidity of cast metal), there is a problem that work operation takes time and effort. Particularly a demand for thinning a cylinder liner, a camshaft and the like becomes severe to minimize the process and an excellent fluidity is required to satisfy such a demand.

Additionally, although the method disclosed in Japanese Patent Application Laid-open Publication No. 2003-171729 adopts the configuration that S is further added to the molten metal, since S causes an occurrence of the slag, which becomes an obstacle to reuse, the addition of S is not preferable.

SUMMARY OF THE INVENTION

An object of the invention is to provide a flake graphite cast iron being highly strong and excellent in cutting performance, which is suitable for use in engine parts of an internal combustion and the like for example, and the production method thereof without using a rare-earth element or a misch metal and the like in particular.

In order to achieve the above object, some aspects of the invention are as follows.

(I) A flake graphite cast iron: containing an A-type graphite in an existence form that a graphite is disorderly without directionality and uniformly distributed; and having a chemical composition containing 2.8 to 4.0 mass % of C, 1.2 to 3.0 mass % of Si, 1.1 to 3.0 mass % of Mn, 0.01 to 0.6 mass % of P, 0.01 to 0.30 mass % of S and the remainder being Fe and evitable impurities, wherein the ratio of the Mn content to the S content (Mn/S) is within a range of 3 to 300.

(II) The flake graphite cast iron according to the aspect (I) above, wherein the C content and the Si content in the chemical composition are 2.8 to 3.7 mass % and 1.4 to 2.5 mass %, respectively, and the ratio (Mn/S) is within a range of 10 to 200.

(III) The flake graphite cast iron according to the aspect (I) or (II) above, wherein the chemical composition further contains at least one component selected from the group consisting of 0.1 to 1.2 mass % of Cu, 0.1 to 0.6 mass % of Cr, 0.1 to 0.6 mass % of Mo and 0.1 to 1.0 mass % of Ni.

(IV) The flake graphite cast iron according to the aspect (I), (II) or (III) above, wherein the chemical composition further contains 0.01 to 0.20 mass % of B.

(V) The flake graphite cast iron according to any one of the aspects (I) to (IV) above, wherein the MnS content in the flake graphite cast iron is, in a number of MnS existing per unit area in a predetermined cross-sectional surface of the flake graphite cast iron, within a range of 200 to 1100/mm$^2$.

(VI) The flake graphite cast iron according to any one of the aspects (I) to (V) above, wherein the flake graphite cast iron is a cast iron for cylinder liner, piston ring, camshaft, cylinder block, cylinder head or brake disc.

(VII) A production method of a flake graphite cast iron containing an A-type graphite in an existence form that a graphite is disorderly without directionality and uniformly distributed, wherein a chemical composition of a molten metal is adjusted to contain 2.8 to 4.0 mass % of C, 1.2 to 3.0 mass % of Si, 1.1 to 3.0 mass % of Mn, 0.01 to 0.6 mass % of P, 0.01 to 0.30 mass % of S and the remainder being Fe and inevitable impurities and have the ratio of the Mn content to the S content (Mn/S) within a range of 3 to 300.

(VIII) The production method of a flake graphite cast iron according to the aspect (VII) above, wherein the molten metal contains at least a portion of a molten material of steel sheet scrap inserted and molten.

(IX) The production method of a flake graphite cast iron according to the aspect (VIII) above, wherein at least one portion of the steel sheet scrap contains not more than 3.0 mass % of Mn and is high-tensile steel sheet scrap containing Mn.

(X) The production method of a flake graphic cast iron according to the aspect (VII), (VIII) or (IX) above, wherein a rare-earth element and a misch metal are not added for the adjustment.

According to the invention, it is possible to provide a flake graphite cast iron being highly strong and excellent in cutting performance, which is suitable for use in engine parts of an internal combustion and the like for example, and the production method thereof without using a misch metal and the like in particular.

BRIEF DESCRIPTION OF THE DRAWING

The invention will be described with the reference to the accompanying drawings, wherein.

DESCRIPTION OF THE PREFERRED EMBODIMENTS

Figure 1:
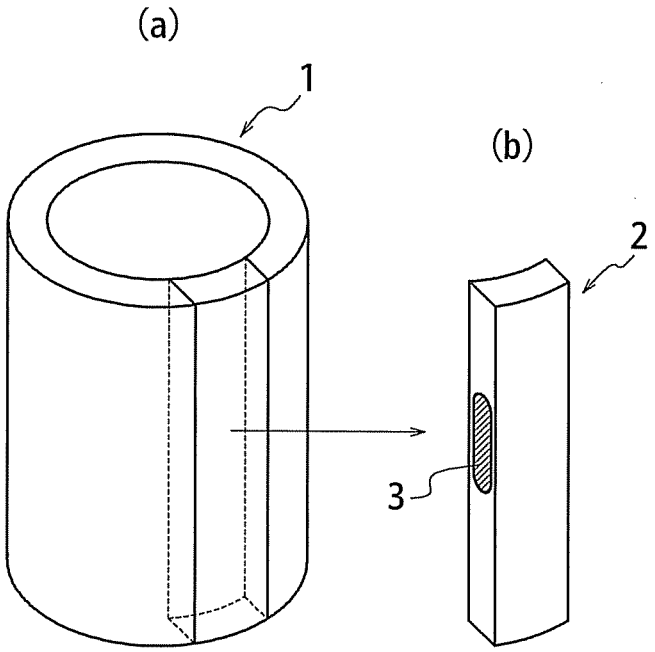
FIG. 1 is a schematic view illustrating a method for measuring a number of MnS existing per unit area.

A flake graphite cast iron according to the invention is a flake graphite cast iron containing an A-type graphite in an existence form that a graphite is disorderly without directionality and uniformly distributed. In the invention, by making a graphite cast iron contain an A-type graphite, it can be complete with high strength and excellent cutting performance. Moreover, the content ratio of the A-type graphite to the graphite existing in the flake graphite cast iron of the invention is preferable to be not less than 70% in area ratio to obtain high strength. As the graphite existing in the flake graphite cast iron other than the A-type graphite, B, D and E-type graphites are cited. Additionally, a matrix of the flake graphite cast iron is composed of a pearlite, a manganese sulfide (MnS) dispersed in the matrix and the like.

Moreover, the flake graphite cast iron of the invention has a chemical composition containing 2.8 to 4.0 mass % of C, 1.2 to 3.0 mass % of Si, 1.1 to 3.0 mass % of Mn, 0.01 to 0.6 mass % of P, 0.01 to 0.30 mass % of S and the remainder being Fe and inevitable impurities, wherein the ratio of the Mn content to the S content (Mn/S) is within a range of 3 to 300.

Next, the reason why the chemical composition of the flake graphite cast iron according to the invention is limited will be described below.

C: 2.8 to 4.0 mass %

The content of C, which is an element of strengthening the matrix as the structure mainly composed of the pearlite, crystallizing the graphite and enhancing wear resistance and scuffing resistance, is required to be not less than 2.8 mass % so as to obtain these effects. On the other hand, when the C content is more than 4.0 mass %, an excessive amount of the graphite and the carbide fosters embrittlement. Therefore, the C content is limited to a range of 2.8 to 4.0 mass %. In addition, when enhancement of strength is considered to be particularly important, the C content is preferable to be 2.8 to 3.7 mass %.

Si: 1.2 to 3.0 mass %

The content of Si, which is one of the basic elements of the cast iron, is required to be at least not less than 1.2 mass % for graphite crystallization. On the other hand, when the Si content is more than 3.0 mass %, the content is excessive and the strength is lowered. Therefore, the Si content is limited to a range of 1.2 to 3.0 mass %. In addition, when enhancement of strength is considered to be particularly important, the Si content is preferable to be 1.4 to 2.5 mass %.

Mn: 1.1 to 3.0 mass %

The content of Mn, which has a function of strengthening a matrix pearlite and is one of the important elements in the invention, is required to be not less than 1.1 mass % for strengthening the pearlite and precipitating MnS. On the other hand, when the Mn content is more than 3.0 mass %, the carbide is easily precipitated and workability deteriorates. Therefore, the Mn content is limited to a range of 1.1 to 3.0 mass %.

P: 0.01 to 0.6 mass %

The content of P, which is an element of crystallizing a steadite (phosphorous eutectic crystal), dispersing it as a hard phase and enhancing wear resistance, is required to be not less than 0.01 mass %. On the other hand, when the P content is more than 0.6 mass %, material characteristics are embrittled. Therefore, the P content is limited to a range of 0.01 to 0.6 mass %.

S: 0.01 to 0.30 mass %

The content of S, which is an element of bonding to Mn to form MnS and enhancing workability, particularly cutting performance, is required to be not less than 0.01 mass %. On the other hand, when the S content is more than 0.30 mass %, material characteristics are embrittled. Therefore, the S content is limited to a range of 0.01 to 0.30 mass %.

Additionally, not only by limiting the chemical composition as above, but also by making the ratio of the Mn content to the S content within a range of 3 to 300, the flake graphite cast iron of the invention can be the flake graphite cast iron being highly strong and excellent in cutting performance, which is suitable for use in engine parts of an internal combustion and the like for example, without using the misch metal and the like in particular. It is because, when the ratio Mn/S is less than 3, only low tensile strength can be obtained, while when the ratio Mn/S is more than 300, cutting performance deteriorates.

Although the ratio is limited to the range of 3 to 300 for balancing and satisfying the both high strength and excellent cutting performance and the ratio Mn/S is preferably within a range of 10 to 120, when enhancement of strength is considered to be particularly important as application to a cylinder liner for example, the range is preferable to be of 10 to 200, and also when cutting performance is considered to be particularly important, the range is preferable to be of 3 to 20.

Moreover, although the basic composition of the flake graphite cast iron according to the invention is as described above and the remainder is composed of Fe and inevitable impurities, in the invention, when high strength and corrosion resistance are considered to be particularly important, 0.1 to 1.2 mass % of Cu, 0.1 to 0.6 mass % of Cr, 0.1 to 0.6 mass % of Mo, 0.1 to 1.0 mass % of Ni and 0.01 to 0.20 mass % of B shown below can be further contained in addition to the above composition if necessary.

Cu: 0.1 to 1.2 mass %

Cu, which is an element of solid solution in the matrix to strengthen it, enhancing wear resistance and enhancing corrosion resistance, can be added if necessary. While these effects are remarkable when the Cu content is not less than 0.1 mass %, when the content is more than 1.2 mass %, the effects are saturated and cannot be expected to match the content. Therefore, the Cu content is within a range of 0.1 to 1.2 mass % and more preferably within a range of 0.5 to 0.8 mass %.

Cr: 0.1 to 0.6 mass %

Cr, which is an element of the solid solution in the matrix to strengthen it, being contained in the carbide to increase carbide hardness and enhancing wear resistance, and can be added if necessary. In order to produce the above effects, the Cr content is preferable to be not less than 0.1 mass %. On the other hand, when the Cr content is more than 0.6 mass %, since an amount of the carbide is excessive and graphite form collapses, cutting performance tends to decrease. Therefore, the Cr content is within a range of 0.1 to 0.6 mass % and more preferably within a range of 0.2 to 0.4 mass %.

Mo: 0.1 to 0.6 mass %

The content of Mo, which is an element of solid solution in the matrix to strengthen it and enhancing material strength, is required to be not less than 0.1 mass %. On the other hand, when the Mo content is more than 0.6 mass %, matrix strength becomes too high and cutting performance tends to decrease. Therefore, the Mo content is within a range of 0.1 to 0.6 mass %.

Ni: 0.1 to 1.0 mass %

The content of Ni, which has a function of solid solution in a ferrite to increase the strength and make the pearlite fine, and also is an element of stimulating graphitization, dispersing the flake graphite in small and uniformly and enhancing heat resistance, corrosion resistance and wear resistance, is required to be not less than 0.1 mass %. On the other hand, when the Ni content is more than 1.0 mass %, the matrix tends to be austenitized. Therefore, the Ni content is within a range of 0.1 to 1.0 mass %.

B: 0.01 to 0.20 mass %

The content of B, which is an important element of generating a boron carbide, forming a hard phase with a phosphorus eutectic crystal to increase the hardness and enhancing wear resistance and scuffing resistance as the same as C, is required to be not less than 0.01 mass % for increasing area ratio of the hard phase and enhancing wear resistance in the invention. On the other hand, when the content is more than 0.20 mass %, the hard phase is excessive and toughness decreases. Therefore, the B content is limited to a range of 0.01 to 0.20 mass %.

Moreover, in the invention, the MnS content in the flake graphite cast iron is, in a number of MnS existing per unit area in a predetermined cross-sectional surface of the flake graphite cast iron, preferable to be within a range of 200 to 1100/$mm^2$. It is because when the number of existing MnS is less than 200/$mm^2$, chip life is shortened and thereby workability tends to deteriorate, while when the number of existing MnS is more than 1100/$mm^2$, the cutting performance is unchanged but the strength tends to decrease. The predetermined cross-sectional surface of the flake graphite cast iron specifically means a cut surface of a bar-like member when a bar-like piece 2 with a width of 10 mm is cut out as shown in FIG. 1 (*b*) along the longitudinal direction from a cylindrical member 1 for cylinder liner, which is produced of a flake graphite cast iron with a diameter of 110 mm, a height of 150 mm and a thickness of 8 mm as shown in FIG. 1, and the measurement area is [0.5 mm×0.5 mm=] 0.25 $mm^2$.

In addition, the flake graphite cast iron of the invention is particularly suitable for use in cylinder liners, piston rings, camshafts, cylinder blocks, cylinder heads or brake discs.

Next, a production method of a flake graphite cast iron according to the invention will be described.

The production method of a flake graphite cast iron using steel sheet scrap according to the invention is a production method of a flake graphite cast iron containing an A-type graphite in an existence form that a graphite is disorderly without directionality and uniformly distributed, wherein a chemical composition in a molten metal is adjusted to contain 2.8 to 4.0 mass % of C, 1.2 to 3.0 mass % of Si, 1.1 to 3.0 mass % of Mn, 0.01 to 0.6 mass % of P, 0.01 to 0.30 mass % of S and the remainder being Fe and inevitable impurities and have the ratio of the Mn content to the S content (Mn/S) within a range of 3 to 300, and by adopting this configuration, it is possible to produce a flake graphite cast iron being highly strong and excellent in cutting performance.

An explanation of the reason for limiting the chemical composition in the molten metal is omitted because it is the same as the reason stated in the above part of the chemical composition of the flake graphite cast iron.

Moreover, in the production method of the invention, the molten metal is preferable to contain at least part of a molten material of steel sheet scrap inserted and molten from the point of reducing raw material cost, and particularly at least part of the steel sheet scrap is more preferable to contain not more than 3.0 mass % of Mn and be high-tensile steel sheet scrap containing Mn.

By this configuration, it is possible to use steel sheet scrap directly as recovered at once to produce a flake graphite cast iron without separately recovering high-tensile steel sheet scrap containing Mn and S and normal steel sheet scrap or removing Mn in a step such as Mn removal treatment.

By having the component in the molten metal within the range as above and the desired ratio of Mn and S, it is possible to obtain high strength and excellent cutting performance.

Additionally in the invention, the addition of a rare-earth element and a misch metal is preferable to be unnecessary from the point of maintaining good fluidity and reducing an occurrence of a slag in the molten metal. Namely it is because, despite the requirement for thinning of a cylinder liner, a camshaft and the like to minimize the process and thus the fluidity of cast metal, the addition of the misch metal and the like significantly deteriorates the fluidity.

Furthermore, from the point of stabilization and soundness of material quality, it is more preferable to further add an inoculation agent of Fe—Si or Ca—Si in the molten metal. The additive amount of the inoculation agent of Fe—Si or Ca—Si is preferable to be 0.1 to 0.6 mass %. Regardless of the kind of the inoculation agent in the molten metal, the inevitable impurities may contain Ca, Al, Ba, Sr, Zr, Bi and Sn and rare-earth elements such as La, Ce, Sm and Y.

Although the above is described to show an example of an embodiment of the invention, various modifications may be made without departing from the scope of the appended claims.

EXAMPLES

Next, examples of the invention will be described.

Examples 1 to 27 and Comparative Examples 1 to 22

High-tensile steel sheet scrap containing Mn, a cast iron, steel scrap and alloys are molten to be a molten metal with a predetermined chemical component, the Mn content and the S content in the molten metal are adjusted by addition to be a predetermined Mn/S ratio, and then the molten metal is teemed into a liner-shaped sand mold to obtain a cylindrical member 1 for cylinder liner made of a flake graphite cast iron with a diameter of 110 mm, a height of 150 mm and a thickness of 8 mm. The chemical composition, the Mn/S ratio and a number of MnS existing per unit area (number/mm$^2$) in the molten metal hereat are shown in Table 1. The number of MnS existing per unit area is obtained by cutting out the bar-like piece 2 with a width of 10 mm as shown in FIG. 1 (*b*) along the longitudinal direction from the cylindrical member shown in FIG. (a), taking total 12 (4 vertical, 3 horizontal) serial photographs of the central portion of the cut surface of the bar-like member in both the longitudinal direction and the width direction (shaded area 3 of FIG. 1 (*b*)) in measurement view of 0.5 mm square with an optical microscope (400 magnifications), measuring a number of MnS within a range of the measurement view in the serial photographs and calculating a number of MnS per unit area (1 mm$^2$) from the measured value.

TABLE 1

| | Chemical composition (mass %) | | | | | | Mn/S | Number of existing MnS | Performance evaluation | |
|---|---|---|---|---|---|---|---|---|---|---|
| No | C | Si | Mn | P | S | Others | ratio | (number/mm$^2$) | Cutting performance | Tensile strength (MPa) |
| Example 1 | 3.8 | 1.2 | 1.1 | 0.01 | 0.15 | — | 7 | 620 | 0.12 | 265 |
| Example 2 | 3.6 | 1.4 | 1.4 | 0.6 | 0.13 | — | 11 | 896 | 0.11 | 301 |
| Example 3 | 3.4 | 2.0 | 1.7 | 0.03 | 0.03 | — | 57 | 480 | 0.13 | 334 |
| Example 4 | 3.2 | 2.4 | 2.4 | 0.2 | 0.03 | — | 80 | 509 | 0.09 | 419 |
| Example 5 | 2.9 | 2.8 | 3.0 | 0.4 | 0.01 | — | 300 | 892 | 0.09 | 433 |
| Example 6 | 3.7 | 1.4 | 1.4 | 0.04 | 0.13 | — | 11 | 1100 | 0.1 | 278 |
| Example 7 | 3.3 | 2.0 | 1.4 | 0.1 | 0.03 | — | 47 | 398 | 0.12 | 381 |
| Example 8 | 2.8 | 2.5 | 2.4 | 0.4 | 0.02 | — | 120 | 497 | 0.13 | 415 |
| Comparative Example 1 | 3.7 | 2.4 | 1.0 | 0.03 | 0.5 | — | 2 | 810 | 0.08 | 203 |
| Comparative Example 2 | 3.3 | 2.8 | 3.1 | 0.2 | 0.009 | — | 344 | 193 | 0.32 | 248 |
| Example 9 | 3.8 | 1.6 | 1.4 | 0.01 | 0.13 | Cu: 0.1 | 11 | 986 | 0.08 | 362 |
| Example 10 | 3.6 | 1.4 | 1.4 | 0.1 | 0.03 | Cu: 0.7 | 47 | 403 | 0.14 | 361 |
| Example 11 | 3.6 | 2.5 | 2.4 | 0.35 | 0.02 | Cu: 1.2 | 120 | 497 | 0.13 | 296 |
| Comparative Example 3 | 3.6 | 2.5 | 1.0 | 0.1 | 0.5 | Cu: 0.05 | 2 | 812 | 0.09 | 231 |
| Comparative Example 4 | 3.5 | 2.6 | 3.1 | 0.35 | 0.009 | Cu: 1.4 | 344 | 190 | 0.17 | 294 |
| Comparative Example 5 | 3.6 | 2.5 | 1.0 | 0.1 | 0.5 | Cu: 0.1 | 2 | 830 | 0.09 | 238 |
| Comparative Example 6 | 3.5 | 2.6 | 3.1 | 0.35 | 0.009 | Cu: 1.2 | 344 | 195 | 0.17 | 278 |
| Example 12 | 3.8 | 1.7 | 1.4 | 0.1 | 0.13 | Cr: 0.1 | 11 | 965 | 0.1 | 264 |
| Example 13 | 3.4 | 1.2 | 1.4 | 0.4 | 0.03 | Cr: 0.4 | 47 | 399 | 0.13 | 394 |
| Example 14 | 3.1 | 2.6 | 2.4 | 0.5 | 0.02 | Cr: 0.6 | 120 | 513 | 0.12 | 407 |
| Comparative Example 7 | 3.8 | 1.7 | 1.0 | 0.4 | 0.5 | Cr: 0.05 | 2 | 870 | 0.11 | 229 |
| Comparative Example 8 | 3.1 | 2.6 | 3.1 | 0.5 | 0.009 | Cr: 0.7 | 344 | 182 | 0.18 | 284 |
| Comparative Example 9 | 3.8 | 1.7 | 1.0 | 0.4 | 0.5 | Cr: 0.1 | 2 | 820 | 0.11 | 230 |
| Comparative Example 10 | 3.1 | 2.6 | 3.1 | 0.5 | 0.009 | Cr: 0.6 | 344 | 176 | 0.18 | 283 |
| Example 15 | 3.9 | 1.8 | 1.4 | 0.1 | 0.13 | Mo: 0.1 | 11 | 924 | 0.10 | 263 |
| Example 16 | 3.6 | 2.4 | 1.4 | 0.4 | 0.03 | Mo: 0.4 | 47 | 409 | 0.14 | 290 |

TABLE 1-continued

| No | Chemical composition (mass %) C | Si | Mn | P | S | Others | Mn/S ratio | Number of existing MnS (number/mm$^2$) | Performance evaluation Cutting performance | Tensile strength (MPa) |
|---|---|---|---|---|---|---|---|---|---|---|
| Example 17 | 3.5 | 2.1 | 2.4 | 0.5 | 0.02 | Mo: 0.6 | 120 | 500 | 0.13 | 303 |
| Comparative Example 11 | 3.9 | 1.8 | 0.8 | 0.1 | 0.4 | Mo: 0.05 | 2 | 870 | 0.09 | 247 |
| Comparative Example 12 | 3.6 | 2.4 | 3.1 | 0.4 | 0.009 | Mo: 0.7 | 344 | 170 | 0.2 | 319 |
| Comparative Example 13 | 3.9 | 1.8 | 0.8 | 0.1 | 0.4 | Mo: 0.1 | 2 | 860 | 0.08 | 248 |
| Comparative Example 14 | 3.6 | 2.4 | 3.1 | 0.4 | 0.009 | Mo: 0.6 | 344 | 165 | 0.2 | 325 |
| Example 18 | 3.1 | 2.8 | 1.4 | 0.2 | 0.13 | Ni: 0.1 | 11 | 870 | 0.1 | 260 |
| Example 19 | 3.5 | 2.2 | 1.4 | 0.1 | 0.03 | Ni: 0.6 | 47 | 392 | 0.13 | 310 |
| Example 20 | 3.3 | 2.4 | 2.4 | 0.2 | 0.02 | Ni: 1.0 | 120 | 510 | 0.15 | 291 |
| Comparative Example 15 | 3.7 | 2.8 | 1.0 | 0.1 | 0.5 | Ni: 0.005 | 2 | 840 | 0.1 | 221 |
| Comparative Example 16 | 3.5 | 2.0 | 3.1 | 0.1 | 0.009 | Ni: 1.5 | 344 | 155 | 0.23 | 248 |
| Comparative Example 17 | 3.7 | 2.8 | 1.0 | 0.1 | 0.5 | Ni: 0.1 | 2 | 860 | 0.1 | 228 |
| Comparative Example 18 | 3.5 | 2.0 | 3.1 | 0.1 | 0.009 | Ni: 1.0 | 344 | 160 | 0.22 | 241 |
| Example 21 | 3.7 | 1.4 | 1.4 | 0.04 | 0.13 | B: 0.01 | 11 | 869 | 0.12 | 277 |
| Example 22 | 3.5 | 2.0 | 1.4 | 0.1 | 0.03 | B: 0.06 | 47 | 387 | 0.15 | 265 |
| Example 23 | 2.8 | 2.5 | 2.4 | 0.4 | 0.02 | B: 0.2 | 120 | 512 | 0.11 | 303 |
| Comparative Example 19 | 3.7 | 1.4 | 1.0 | 0.04 | 0.5 | B: 0.005 | 2 | 805 | 0.1 | 243 |
| Comparative Example 20 | 3.5 | 2.0 | 3.1 | 0.1 | 0.009 | B: 0.21 | 344 | 185 | 0.21 | 247 |
| Comparative Example 21 | 3.7 | 1.4 | 1.0 | 0.04 | 0.5 | B: 0.01 | 2 | 810 | 0.11 | 243 |
| Comparative Example 22 | 3.5 | 2.0 | 3.1 | 0.1 | 0.009 | B: 0.2 | 344 | 170 | 0.21 | 241 |
| Example 24 | 3.6 | 2.4 | 1.4 | 0.4 | 0.03 | Cu: 0.7, Cr: 0.4 | 47 | 377 | 0.14 | 278 |
| Example 25 | 3.5 | 2.1 | 2.4 | 0.5 | 0.02 | Cu: 1.0, Mo: 0.3 | 120 | 488 | 0.14 | 312 |
| Example 26 | 3.6 | 2.4 | 1.4 | 0.4 | 0.03 | Cu: 0.7, Cr: 0.4, B: 0.13 | 47 | 342 | 0.15 | 285 |
| Example 27 | 3.5 | 2.1 | 2.4 | 0.5 | 0.02 | Cu: 1.0, Mo: 0.3, B: 0.08 | 120 | 529 | 0.13 | 333 |

(Test Method)

With respect to each of the above flake graphite cast irons, tensile strength and cutting performance are evaluated.

(1) Tensile Strength (TS)

Figure 2:
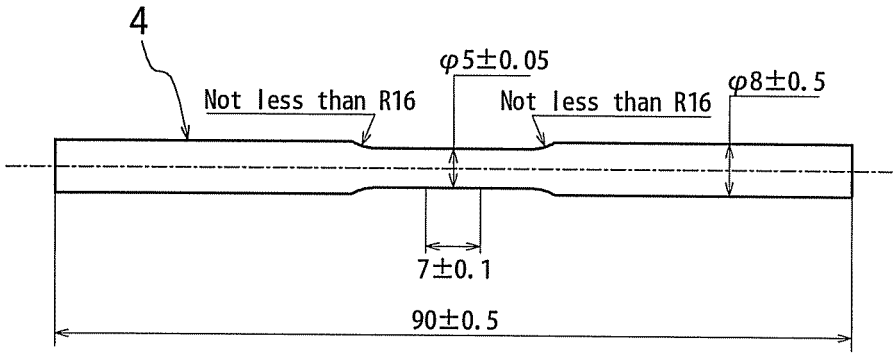
FIG. 2 is a plane view of a tensile test piece for measuring tensile strength.

A tensile strength testing piece 4 shown in FIG. 2 is cut out from each of the above flake graphite cast irons and subjected to a tensile strength test under the condition of tension speed of 1 mm/min. The evaluation results are shown in FIG. 1.

(2) Cutting Performance

Figure 3:
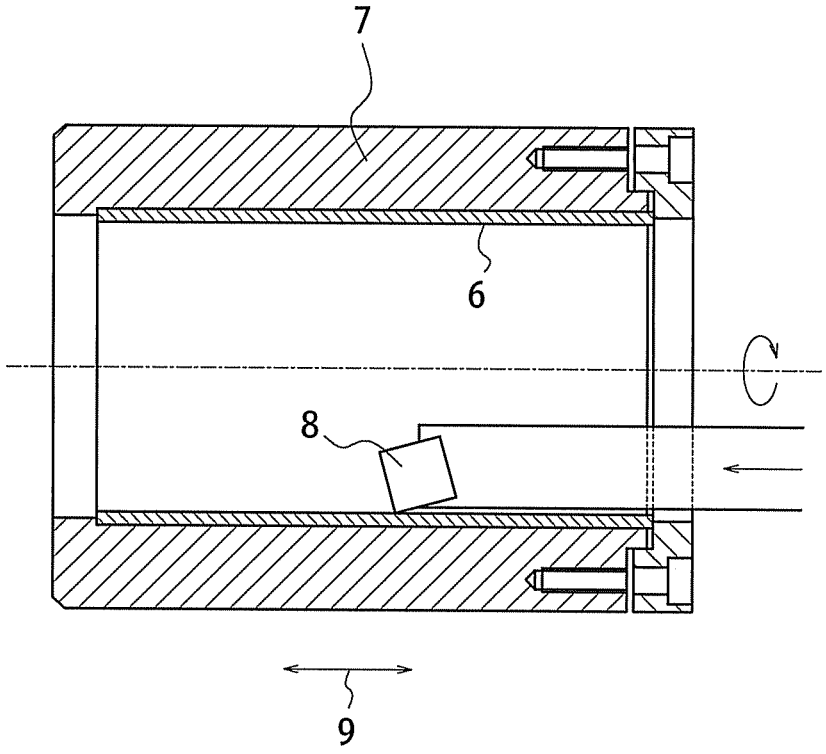
FIG. 3 is a schematic view illustrating a method for evaluating cutting performance.

The cylindrical member 1 for cylinder liner produced above is cut to a thickness of 4 mm as a cylinder liner 6, the cylinder liner 6 is loaded and fixed to a jig 7 of steel as shown in FIG. 3 for reconstructing a state of the cylinder liner 6 cast-wrapped by a block, cutting is performed by revolving the jig 7 on an NC lathe TN-41TS made by Fuji Machinery Co. Ltd. (not shown) and moving a chip 8 along the longitudinal direction 9 on the inner surface of the cylinder liner 6, and edge wear (flank wear, crater wear) quantity of the chip 8 is measured after the process to evaluate cutting performance from the measured value. The cutting conditions are that an SPP434 made by Sumitomo Electric Industries (material: BNX4, Nose R1.6) is used as the chip 8, revolving speed of the jig is 385.5 m/min (1500 rpm), feed speed of the chip 8 is 0.32 mm/rev, cutting depth is 0.15 mm, side cutting edge angle is 75° and it is a dry cutting without using a cutting fluid.

As seen from the evaluation results of Table 1, all Examples 1 to 27 are highly strong and excellent in cutting performance with tensile strength of more than 250 MPa and cutting performance of not more than 0.15. On the other hand, Comparative Examples 1 to 22 have either tensile strength of less than 250 MPa or poor cutting performance.

According to the invention, it is possible to provide a flake graphite cast iron being highly strong and excellent in workability such as cutting performance, which is suitable for use in engine parts of an internal combustion and the like for example, and the production method thereof without using a misch metal and the like in particular.

The invention claimed is:

1. A flake graphite cast iron containing A-type graphite existing in a form in which an orientation of the A-type graphite is disordered and in which the A-type graphite is uniformly distributed, wherein the flake graphite cast iron has a composition excluding rare earth elements and misch metals, the composition comprising, in mass %, C, 2.8-3.7%; Si, 1.4-2.5%; Mn, 1.1-3.0%; P, 0.01-0.6%, S, 0.01-0.30%; and B, 0.06-0.20% and the remainder being Fe and inevitable impurities, and has a chemical composition in which a ratio of the Mn content with respect to the S content (Mn/S) is in a range of at least 47 to no more than 300;

wherein the MnS content in the flake graphite cast iron is in a range of 200-1100 number/$mm^2$ as an existing number of MnS per a unit area on a predetermined cross section of the flake graphite cast iron.

2. The flake graphite cast iron according to claim 1, wherein the chemical composition further contains at least one component selected from the group consisting of 0.1 to 1.2 mass % of Cu, 0.1 to 0.6 mass % of Cr, 0.1 to 0.6 mass % of Mo and 0.1 to 1.0 mass % of Ni.

3. The flake graphite cast iron according to claim 1, wherein the flake graphite cast iron is for a cylinder liner, a piston ring, a camshaft, a cylinder block, a cylinder head or a brake disc.

* * * * *